United States Patent [19]

Heller et al.

[11] 3,933,196

[45] Jan. 20, 1976

[54] MOVABLE OPENINGS SHUTTING UP ELEMENTS FOR THE REDUCTION OF WIND ACTIVITY AT COOLING EQUIPMENTS

[75] Inventors: Laszlo Heller; Laszlo Forgo; Gyorgy Bergmann; Gyorgy Palfalvi, all of Budapest, Hungary

[73] Assignee: Transelektro Magyar Villamossagi, Budapest, Hungary

[22] Filed: Aug. 20, 1973

[21] Appl. No.: 389,825

[30] Foreign Application Priority Data

Aug. 29, 1972 Hungary ..... HE 616

[52] U.S. Cl. ..... 165/1; 165/100; 165/129; 261/109; 261/DIG. 11

[51] Int. Cl.[2] ..... F28F 13/06; F28F 27/02

[58] Field of Search..... 165/100, 128, 129; 261/109, DIG. 11

[56] References Cited

UNITED STATES PATENTS

| | | | |
|---|---|---|---|
| 1,986,653 | 1/1935 | Wade | 261/DIG. 11 |
| 2,346,410 | 4/1944 | Ashley et al. | 165/100 |
| 2,680,603 | 6/1954 | Taylor | 261/DIG. 11 |
| 2,907,554 | 10/1959 | Heller | 261/DIG. 11 |
| 3,608,873 | 9/1971 | Furlong | 261/DIG. 11 |
| 3,635,042 | 1/1972 | Spangemacher | 261/DIG. 11 |

FOREIGN PATENTS OR APPLICATIONS

| | | | |
|---|---|---|---|
| 84,190 | 2/1957 | Netherlands | 261/DIG. 11 |
| 577,550 | 5/1933 | Germany | 261/DIG. 11 |

*Primary Examiner*—Albert W. Davis, Jr.
*Assistant Examiner*—Sheldon Richter
*Attorney, Agent, or Firm*—Blum, Moscovitz, Friedman & Kaplan

[57] ABSTRACT

Movable shutting up elements are provided for eliminating the diminishing effect of the wind on cooling equipment erected in open air. The movable openings shutting up elements are adjusted by a control or regulating device according to actual wind conditions, to effect a damming of pressure in the path of the streaming air in front of the heat exchanging surface, enabling the wind energy to be used to aid in increasing the cooling effect. The opening and closing of elements rotatable around a vertical axis may be used to utilize to a greater extent the wind energy in addition to their wind reflecting effects.

4 Claims, 5 Drawing Figures

MOVABLE OPENINGS SHUTTING UP ELEMENTS FOR THE REDUCTION OF WIND ACTIVITY AT COOLING EQUIPMENTS

BACKGROUND OF THE INVENTION

It is well known that in certain technologies, especially those which require thermal power stations, important quantities of heat are transferred to the surroundings. In order to convey this heat quantity into the ambient air, cooling equipment based on various principles have been developed.

Because such cooling apparatus requires large dimensions they are always located in open air. Thus they are exposed to various atmospheric conditions, of which wind is the most significant. In such cooling apparatus the streaming through of air which serves to cool such air is effected in a forced manner (by ventilators), or by a chimney working in combination with a natural draft, utilizing the lower specific weight of the heated air. In both types of equipment, the quantity of air streaming through the cooling apparatus is lowered by the action of the wind, thus reducing the cooling effect thereof.

Reduction in the quantity of air is due to the air flowing around the cooling equipment, producing unfavorable streaming conditions as compared with wind still conditions. One effect of such wind is the non-uniform air distribution at the entrance and a second is the additional resistance (turbulence and distortion of streaming) inside cooling apparatus in the path of the draft. Unevenness of air distribution cause the heat exchanger to receive air which has been warmed up already in another part of the apparatus, which also lessens the cooling effect.

Certain methods have been used to reduce the harmful effect of the wind. One such method uses various partition and guide walls built into the cooling apparatus, which partitions and guide walls are designed to make the air entrance uniform. Such attempts however when practically tested have had limited results because such solutions do not ameliorate the unfavorable streaming conditions which arise from the wind flowing around the cooling equipment.

SUMMARY OF THE INVENTION

Generally speaking, in accordance with the invention, movable openings closing up elements are provided for eliminating the wind effect and using the wind energy to increase the cooling effect. This is achieved by placing at the entrance of the cooling equipment the shutting up elements to effect a damming up field, in which the action of the wind causes an increase in air pressure and consequently a rise in the quantity of air flowing through the heat exchanger. An essential part of the inventive concept is utilization of the principle of controlling or adjusting the wind by actuating the shutter elements at any time in a manner corresponding to the direction and intensity of wind, to thereby insure a maximum cooling effect.

Accordingly, it is an object of this invention to provide an improved heat exchanger capable of eliminating detrimental wind effects thereupon.

Still other objects and advantages of the invention will in part be obvious and will in part be apparent from the specifications and drawings.

The invention accordingly comprises the features of construction, a combination of elements, an arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description to be taken in connection with the accompanying drawings, in which.

DESCRIPTION OF THE PREFERRED EMBODIMENT

Figure 1:
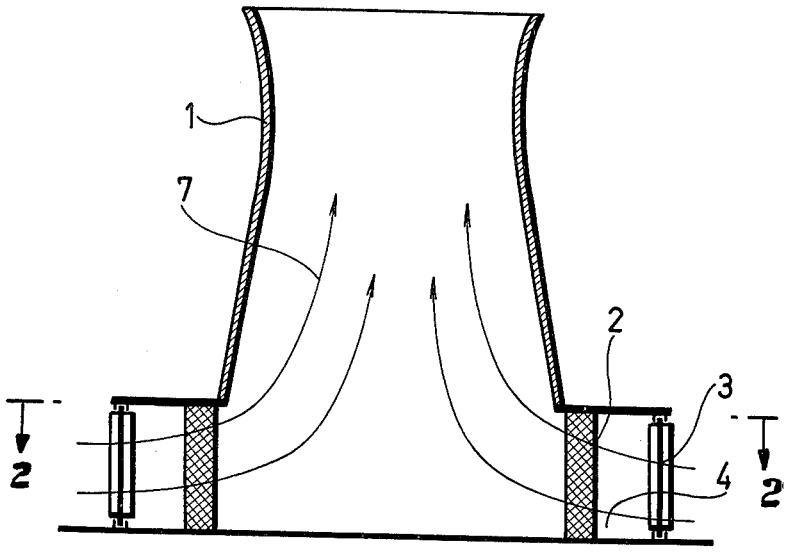
FIG. 1 is a sectional view of cooling equipment including a heat exchanger constructed in accordance with a preferred embodiment of the instant invention.
Figure 2A:
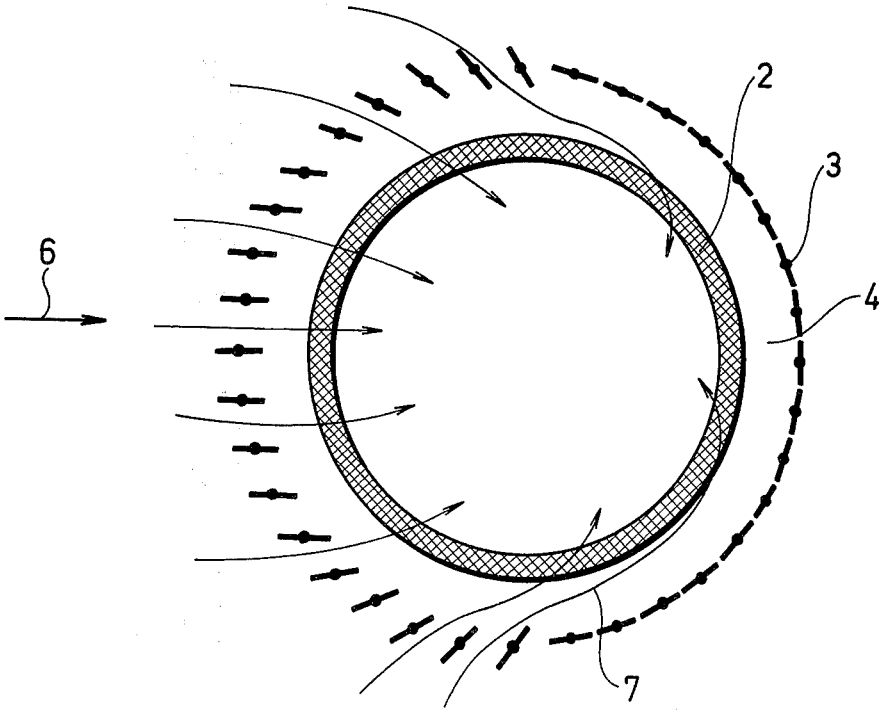
FIGS. 2*a* and 2*b* are sectional views taken along the line 2—2 in FIG. 1 with the shutter elements shown in different adjusted positions.
Figure 2B:
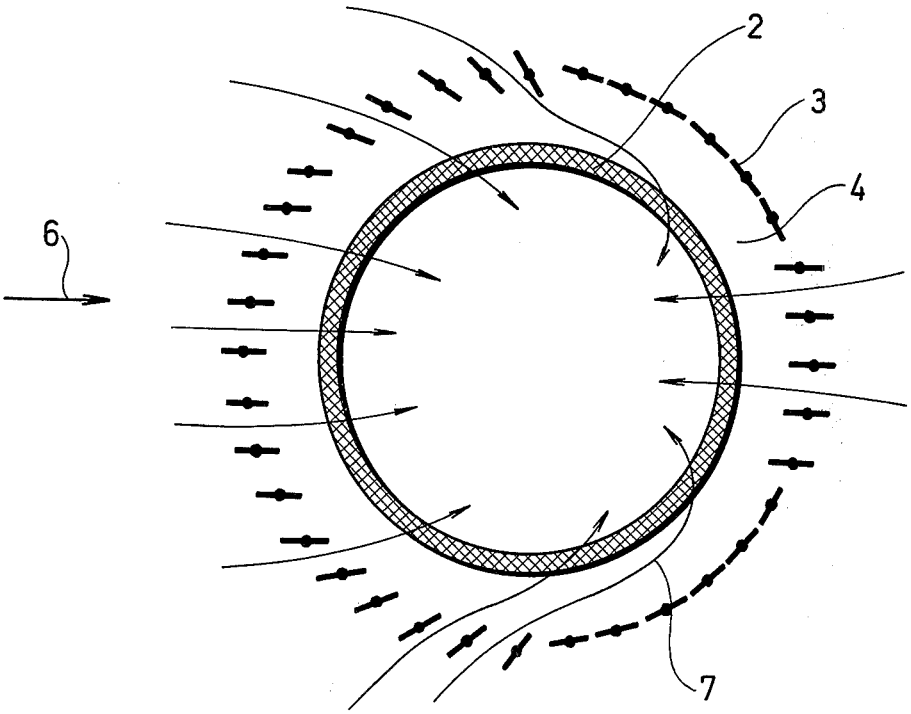

Referring now to FIGS. 1, 2*a* and 2*b* the cooling equipment illustrated therein is of the natural draft variety and includes as its essential element a chimney 1. A heat exchanger 2 is so arranged that air, illustrated by arrows 7, streams through it horizontally. Movable openings shutter elements 3 are positioned to rotate about a vertical axis and form a cylindrical jacket by encircling the damming-up field, illustrated herein as ring shaped.

As depicted in FIG. 2*a* with the chimney 2 removed, the direction of the wind is shown by arrows 6, and as is appreciated, movable openings shutter elements are made to rotate about a vertical axis to most favorably direct the wind into the damming-up field illustrated as 4.

Adjustment of the openings shutter elements is effected in any well known manner such as hydraulic, pneumatic or hand operated controls or adjusting apparatus, which receive impulses from devices sensing both the speed and direction of the wind, and data which characterizes the performance of the apparatus (e.g. temperature of the cooling water) to thereby effect the most favorable cooling affect by the adjustment of the openings shutting up elements. During windstill conditions, the openings closing up elements are fully opened.

In a strong wind, the adjustment as shown in FIG. 2*b* is used, the essential element of which is that the shutters on the side opposite to the wind direction are totally closed, and the remaining shutters are adjusted to angles varying along the circumference so as to direct the wind toward the inside room. Thus as is appreciated, the directing effect of shutters is utilized as well. As a result of shutting up the side opposite to the wind direction, the motion of the wind is transformed into a damming up pressure damming field 4. Since the air 7 entering the cooling equipment cannot escape elsewhere, it flows through the heat exchanger and the chimney into the open air. Thus the damming up pressure of the wind is added to the draft and ameliorates the working condition of the cooling equipment.

In weaker winds the effect of closing up the side opposite to the wind direction is poor, and in such cases the increasing pressure of the dam point which rises upon the action of the wind flowing around the cooling apparatus on the side opposite to the direction to the wind is utilized by opening some of the shutters proximate to the dam point as is depicted in FIG. 2*b*.

Figure 3:
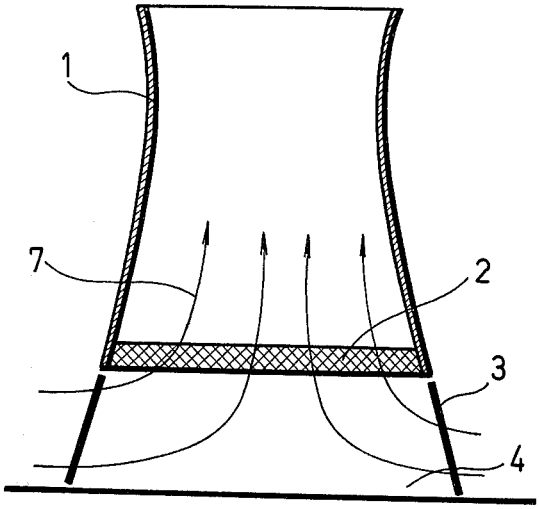
FIG. 3 is a sectional view of an alternative embodiment of a heat exchanger in combination with a chimney constructed in accordance with the instant invention.

Reference is now made to FIG. 3 wherein a further embodiment of the instant invention is illustrated. The openings shutter elements 3 established from the damming up field 4 are connected to the feet which support the chimney. The heat exchanger 2 is located at the base of chimney 1 and as the air is passed into the chimney vertically through the heat exchanger 2, such configuration provides the same results as hereinabove mentioned.

Figure 4:
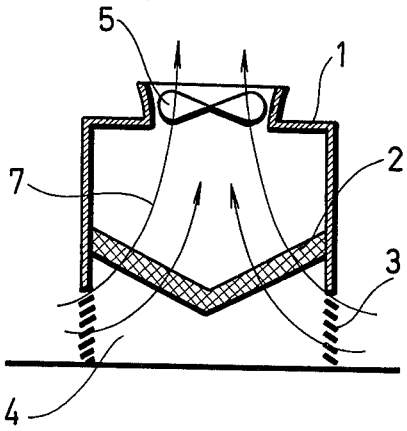
FIG. 4 is a sectional view of still another alternative embodiment of a heat exchanger coupled to a chimney constructed in accordance with the instant invention.

Still another embodiment of the instant invention is illustrated in FIG. 4 in which cooling equipment is shown which includes a forced draft, the essential part of which is a ventilator 5 established at the top of chimney 1. As is illustrated therein the air streams 7 are inclined through heat exchanger 2 by means of openings shutter elements which are displaced on a horizontal axis and effect a damming up field 4 by arranging the shutter elements along the plane walls.

It will thus be seen that the objects set forth above, and those made apparent from the preceding description, are efficiently attained and, since certain changes may be made in the above constructions without departing from the spirit and scope of the invention, it is intended that all matter contained in the above description that are shown in the accompanying drawings shall be interpreted as illustrative and not a limiting sense.

It is also to be understood that the following claims are intended to cover all of the generic and specific features of the invention herein described, and all statements of the scope of the invention which, as a matter of language, might be said to fall therebetween.

What is claimed is:

1. A method of heat transfer in cooling equipment including a heat exchanger, a chimney for drawing cooling air through said heat exchanger and selectively movable openings closing elements surrounding said heat exchanger for controlling air flow through said heat exchanger and up said chimney, an improved method comprising selectively setting the positions of said elements in response to existing conditions of wind direction, strength and cooling equipment operating conditions to define a damming area of preselected extent between said heat exchanger and said elements whereby to control said flow of cooling air.

2. In the method as claimed in claim 1, wherein setting of the positions of the elements includes complete opening of the elements on the side facing into the direction of the wind, the closing of the elements on the side facing away from the wind, and partially opening of each element on the sides intermediate the sides facing into and away from the wind, the number of totally closed elements and the degree to which each of the partially opened elements is opened being determined in response to conditions of wind direction and cooling apparatus operating conditions.

3. In the method claimed in claim 1, wherein each element is independently set to define said damming area in response to said existing conditions of wind direction, strength and the cooling equipment operating conditions.

4. In the method claimed in claim 3, wherein the selective setting of said elements is effected by rotating same about a vertical axis through a range of 180°.

* * * * *